United States Patent [19]

Richards

[11] 4,086,794

[45] May 2, 1978

[54] GATE LOCK MECHANISM

[76] Inventor: Fred F. Richards, 6837 Chevy Chase, Dallas, Tex. 75225

[21] Appl. No.: 702,708

[22] Filed: Jul. 6, 1976

[51] Int. Cl.[2] ..... E05B 65/06

[52] U.S. Cl. ..... 70/134; 70/152; 292/147

[58] Field of Search ..... 70/134, 386, 295, 150, 70/152; 292/145, 147, 252, 175, 150

[56] References Cited

U.S. PATENT DOCUMENTS

| | | | |
|---|---|---|---|
| 219,024 | 8/1879 | Sanborn | 292/175 X |
| 451,356 | 4/1891 | Ayres | 70/295 X |
| 1,045,891 | 12/1912 | Robertson | 292/333 |
| 2,116,001 | 5/1938 | Schlage | 70/134 X |
| 2,116,965 | 5/1938 | Schoorel et al. | 70/386 |
| 3,234,767 | 2/1966 | Allander | 70/386 X |
| 3,653,236 | 4/1972 | Kerr | 70/386 X |
| 3,666,306 | 5/1972 | Genakis | 70/152 X |
| 3,748,880 | 7/1973 | Atkins | 292/150 X |
| 3,877,261 | 4/1975 | Robins | 292/147 X |
| 3,933,380 | 1/1976 | Wellekens | 292/175 |

FOREIGN PATENT DOCUMENTS

| | | | |
|---|---|---|---|
| 615,032 | 2/1961 | Canada | 70/134 |
| 142,174 | 4/1920 | United Kingdom | 70/295 |
| 538,722 | 8/1941 | United Kingdom | 70/134 |

*Primary Examiner*—Roy D. Frazier
*Assistant Examiner*—Rodney H. Bonck

[57] ABSTRACT

A lock mechanism housed in a steel case and directly weldable to iron doors, gates, grilles and similar objects, a bolt slideable in either direction along its longitudinal axis, a fixed member adjacent a long side of said bolt, said fixed member having an opening alignable with a dimple in said bolt side, a sliding member driven in either direction along its longitudinal axis by key or knob operated lock cylinder mechanisms, said sliding member having an opening alignable with dimple in said bolt, a ball retained in opening of fixed member and movable between dimple in said bolt and opening in said sliding member.

2 Claims, 5 Drawing Figures

GATE LOCK MECHANISM

This invention relates to a gate lock, and especially to a type which is directly weldable to iron gates, doors and other similar objects. This invention utilizes a sliding bolt operated manually by means of a shaft passing through said bolt and extending beyond the exterior walls of the lock housing, said sliding bolt is lockable by means of conventional lock cylinders.

The prime object of the invention is to provide a gate lock mechanism housed in a steel housing, said steel housing being designed for attachment to a gate by welding.

Another object of this invention is to provide a gate lock which can be locked or unlocked from either the inside or outside of said gate by a key.

Another object of this invention is to provide a gate lock in which lock cylinders of the conventional mortise type are used, said lock cylinders being installed on either or both sides of said lock housing.

A still further object of this invention is to provide a gate lock mechanism having a sliding bolt in which said sliding bolt can be operated manually without using a key when in an unlocked condition.

A further object of my invention is to provide a gate lock mechanism operable by a single keyed mortise cylinder installed on one side of said lock housing.

With the above and other objects in view, the invention consists in the construction and novel combination and arrangement of parts hereinafter fully described, illustrated in the accompanying drawings and pointed out in the claims hereto appended, it being understood that various changes in form, proportions and minor details of construction, within the scope of the claims, may be resorted to without departing from the spirit or sacrificing any of the advantages of the invention.

Referring to the drawings, wherein like reference characters indicate like parts or elements throughout the several views.

Figure 1:
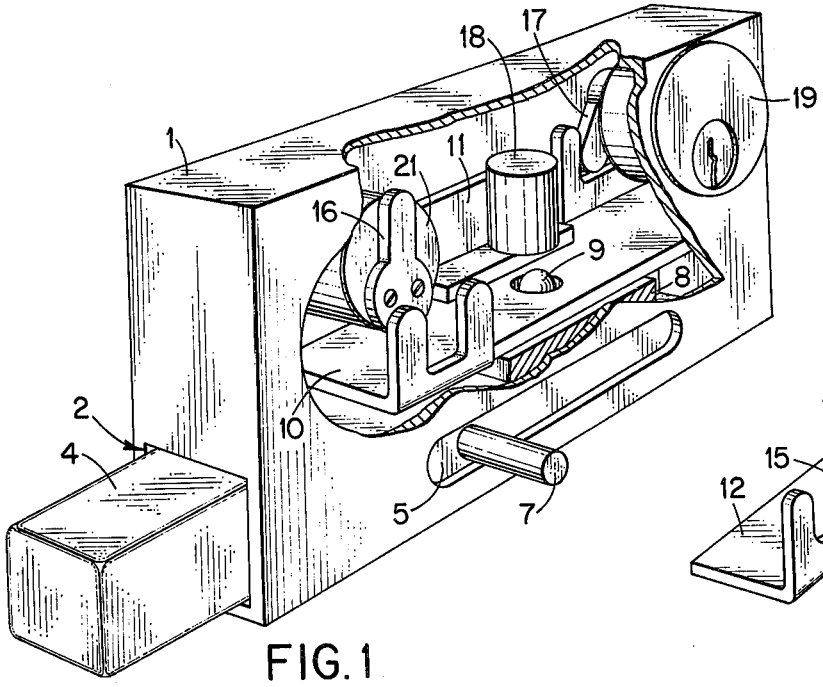
FIG. 1 is a cut-away perspective view of the interior arrangement of the various parts in the unlocked condition.

In the accompanying drawings are illustrated a lock housing 1 of essentially rectangular shape having fixed ends. Said fixed ends have apertures 2 and 3 which serve as supports for sliding bolt 4. Said sliding bolt 4 extends horizontally beyond the fixed ends of said housing 1, as is the usual construction for slidable bolt locks in everyday use. At or near the midpoint along the upper surface of said sliding bolt 4 is a dimple recess 20.

Horizontal slots 5 and 6 are located on each side of said housing 1 to receive a handle shaft 7. Said handle shaft passes through a transverse hole in said sliding bolt 4 and serves to retain said bolt within said housing 1 by limiting the travel of said sliding bolt 4 to the limits set by the length of said horizontal slots 5 and 6.

A ball-retainer member 8 is permanently fixed within said housing 1 adjacent to the upper surface of said sliding bolt 4. Said ball-retainer member 8 has a hole through it and in this hole is placed a steel ball 9. Said steel ball 9 has a diameter smaller than the hole in said ball-retainer 8 and is free to turn in said ball-retainer hole. Said ball-retainer member having a thickness of approximately two-thirds the diameter of said ball 9.

Immediately above said ball-retainer 8 is slideably mounted a locking-plate member 10. Said locking-plate 10 being retained in slideable relationship with the upper surface of ball-retainer 8 by a guide-retainer 11. Said guide-retainer being permanently fixed to the inner wall of said housing 1.

Figure 4:
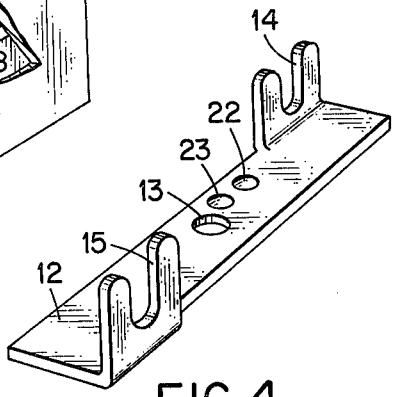
FIG. 4 is a detailed perspective of the locking-plate member.
Figure 2:
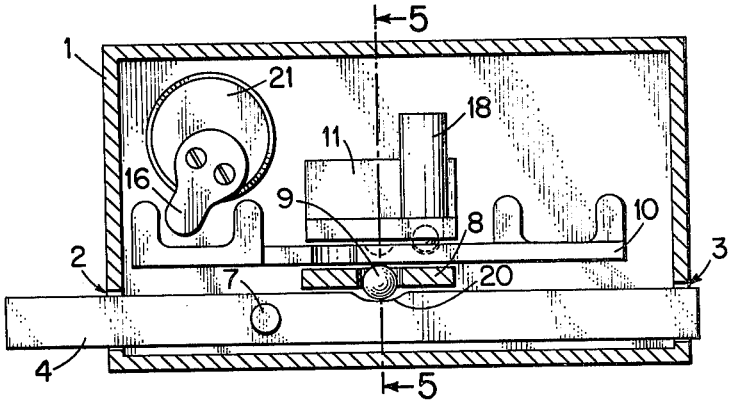
FIG. 2 is a fragmentary view of the arrangement of parts within the housing when bolt is in locked position.
Figure 5:
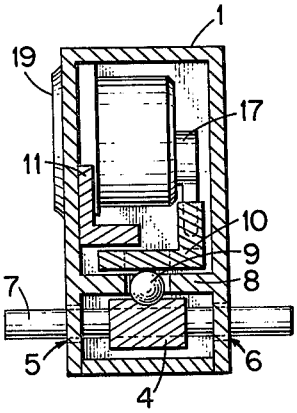
FIG. 5 is a cross-sectional view taken at 5—5 in FIG. 2.

Details of locking-plate member 10 are better understood by referring to FIG. 4 where it is shown to consist of a flat plate 12 with a hole 13 having a diameter in excess of the diameter of steel ball 19 near its approximate center, a sprocket segment 14 turned up at right angles to the plane of said flat plate 12, said sprocket segment 14 being located along the edge of and to the extreme end of said flat plate 12, a second sprocket segment 15 being located in the same plane as the first sprocket segment and along the opposite edge and at the opposite end of said flat plate 12.

Horizontal movement of locking-plate member 10 is accomplished by means of rotating cams 16 or 17. Said cams 16 and 17 being rotated by a conventional key as part of an ordinary mortise lock cylinder.

A common type spring loaded ball detent 18 is attached to guide retainer 11 and located to engage dimple 22 on locking plate member 10 when sliding bolt 4 is in locked position. Said spring loaded ball detent 18 will engage dimple 23 on locking-plate member 10 when sliding bolt 4 is in the unlocked position.

Figure 3:
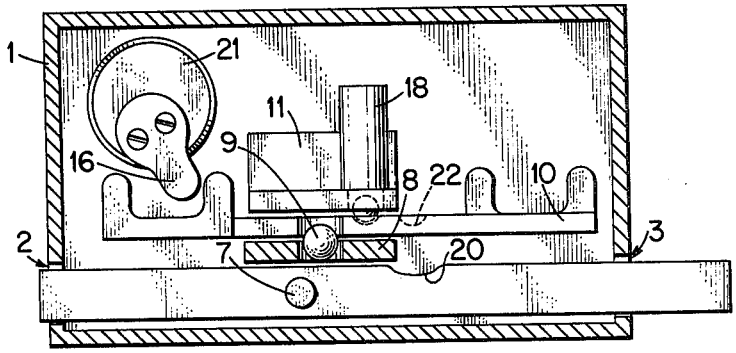
FIG. 3 is a fragmentary view of the arrangement of parts when bolt is in unlocked position.

In use, the action of the mechanism is as follows: In the unlocked condition as at FIG. 1 and FIG. 3, the cams 16 and 17 are in an upright position and not engaged in the sprocket segments 14 or 15. Steel ball 9 is free to move upward through ball-retainer member 8 and into hole 13 of locking-plate member 10. With the steel ball 9 free to move, it cannot restrict lateral movement of sliding bolt 4 and said sliding bolt 4 can now be manually advanced or retracted by means of handle shaft 7. Therefore, in the unlocked condition, this locking mechanism is useful as a common bolt lock.

In order to lock the sliding bolt where it cannot be retracted, it is first necessary to advance the sliding bolt 4 until steel ball 9 drops into dimple 20. Said dimple 20 in sliding bolt 4 having a depth of approximately one-third the diameter of said steel ball 9. With steel ball 9 resting in dimple 20, the hole 13 in locking-plate member 10 is empty and there is nothing to restrict the horizontal movement of locking-plate member 10. By turning either cam 16 or 17 by means of a suitable key locking-plate member 10 is caused to move whereupon hole 13 in said locking-plate member 10 no longer is positioned over steel ball 9 and the flat plate portion 12 of locking-plate member 10 retains steel ball 9 within the guide-retainer member 8 and dimple 20.

With steel ball 9 no longer free to move out of dimple 20, the sliding bolt 4 is effectively locked against being further advanced or retracted.

Two mortise cylinders 19 and 21 are removably attached to opposite walls of said housing 1 and drive said locking-plate member 10 by means of cams which engage sprocket segments 14 and 15 on said locking-plate member 10.

While it will be apparent that the preferred embodiments of the invention herein disclosed are well calculated to fulfill the objects above stated, it will be appreciated that the invention is susceptible to modification, variation and change.

I claim:

1. A locking device comprising a housing having a first fixed member therein, a second fixed member spaced apart from and parallel to the first fixed member, a movable member slideably sandwiched between the first and second fixed members, a bolt extending through said housing slideably adjacent and parallel to the second fixed member, extending axially beyond at least one end of said housing, and having means intermediate the ends thereof for cooperation with a detent means in said members, said detent means comprising gravity-actuated means in said members for cooperation with said detent cooperation means on said bolt to prohibit movement of said bolt when the latter is in at least one position relative to said fixed members, means for positively retaining said detent means in contact with said detent cooperation means on said bolt to positively prohibit relative movement between said bolt and said fixed members, said gravity-actuated detent means consisting of a ball having a diameter greater than the thickness of said second fixed member, said ball loosely confined in a hole extending through said second fixed member, said movable member having an opening therethrough to receive a portion of said ball when the opening through said movable member is aligned with the hole through said second fixed member, said opening through said movable member being covered and obstructed on one side by said first fixed member, said detent cooperating means in said bolt being adapted to receive a portion of said ball, means for slideably actuating said movable member to confine said ball in a mutual cavity consisting of said hole in second fixed member and detent cooperating means in said bolt, said means for slideably actuating said movable member comprising at least one cam engaging means on said movable member, a pair of cams mounted on opposite inside surfaces of said housing rotatable in cooperation with said cam engaging means and driven by a pair of cam operating means each operable from their respective side of said housing, said movable member being slideably actuated by either of said cams acting upon said cam engaging means to cause the alignment or misalignment of said opening in said movable member with said hole in said second fixed member.

2. The device of claim 1 including a spring-loaded detent mounted in fixed relationship within said housing, a first and second detent engaging means on said movable member positioned to allow said first detent engaging means to engage said spring-loaded detent when said opening in said movable member is aligned with said hole in said second fixed member, said second detent engaging means on said movable member positioned to engage said spring-loaded detent when said opening in said movable member is misaligned with said hole in said second fixed member.

* * * * *